United States Patent [19]

Hedelin

[11] Patent Number: 4,498,352

[45] Date of Patent: Feb. 12, 1985

[54] CAM APPARATUS WITH A ROTATABLE, VARIABLE-PROFILE CAM MEANS

[76] Inventor: Lars G. B. Hedelin, Skärsnäsvägen 5, S-18263 Djursholm, Sweden

[21] Appl. No.: 385,393

[22] PCT Filed: Sep. 14, 1981

[86] PCT No.: PCT/SE81/00259

§ 371 Date: May 25, 1982

§ 102(e) Date: May 25, 1982

[87] PCT Pub. No.: WO82/01217

PCT Pub. Date: Apr. 15, 1982

[30] Foreign Application Priority Data

Sep. 29, 1980 [SE] Sweden ..... 8006793

[51] Int. Cl.[3] ..... F16H 53/00

[52] U.S. Cl. ..... 74/568 R; 123/90.17

[58] Field of Search ..... 74/567, 568 R, 569; 123/90.17, 90.18

[56] References Cited

U.S. PATENT DOCUMENTS

| | | | |
|---|---|---|---|
| 1,757,046 | 5/1930 | Horine | 74/568 R |
| 2,829,540 | 4/1958 | Niemeyer | 74/569 |
| 2,888,837 | 6/1959 | Hellmann | 123/90.17 X |
| 3,523,465 | 8/1970 | Harrell | 74/568 R |
| 3,688,593 | 9/1972 | Ustin | 74/568 R X |

FOREIGN PATENT DOCUMENTS

| | | | |
|---|---|---|---|
| 703586 | 3/1941 | Fed. Rep. of Germany . | |
| 2921645 | 12/1980 | Fed. Rep. of Germany | 123/90.17 |
| 1109790 | 2/1956 | France | 123/90.17 |

OTHER PUBLICATIONS

Artobolevski, I., *Les Mecanismes dans la Technique Moderne,* vol. 4, Editions MIR, Moscow, 1977, p. 126.

*Primary Examiner*—Stephen J. Novosad
*Assistant Examiner*—Frank H. McKenzie, Jr.
*Attorney, Agent, or Firm*—Ostrolenk, Faber, Gerb & Soffen

[57] ABSTRACT

A cam apparatus is disclosed which has a cam profile which is varied by axially moving the drive shaft. Two cam members on the shaft form a cam lobe. Guide bodies mounted in the shaft engage slanted grooves on the inner walls of the cam members, so that axially moving the drive shaft turns the cam members. In one embodiment, the cam members may meet in the area of the cam lobe when the cam lobe is narrow, and may be spaced apart when it is wide, or they may overlap when it is narrow and provide a continuous profile when it is wide.

19 Claims, 16 Drawing Figures

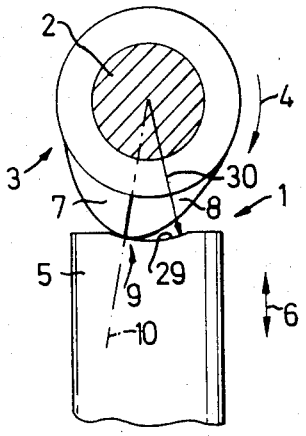
FIG.1
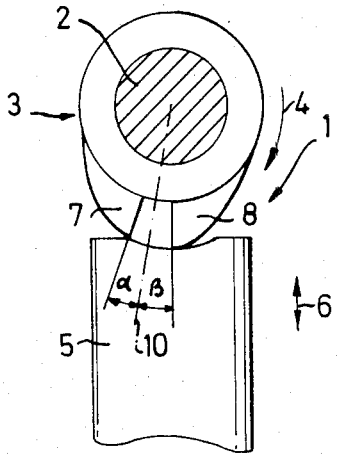
FIG. 2
FIG.3
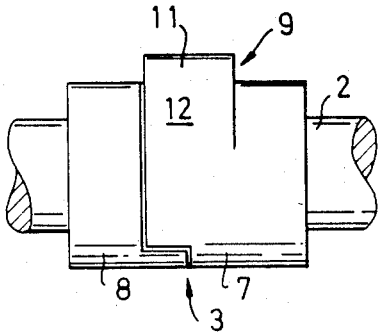
FIG.5
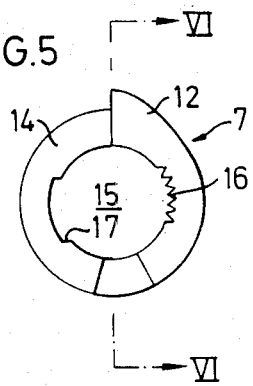
FIG.4
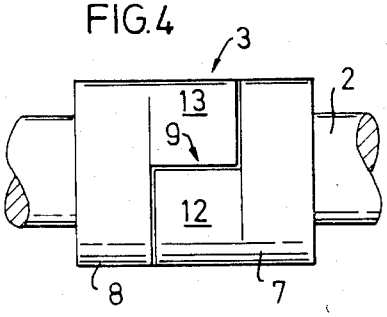
FIG.6
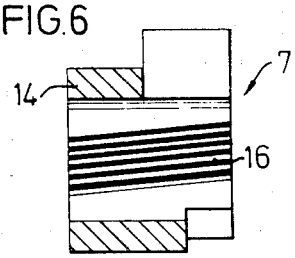

FIG. 7
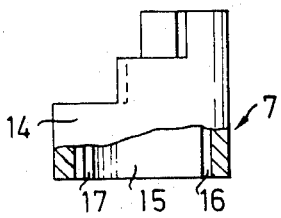
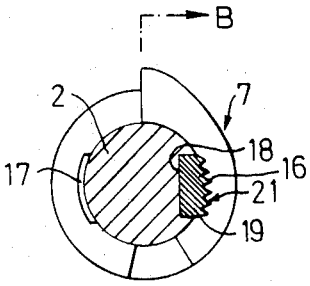
FIG. 8A
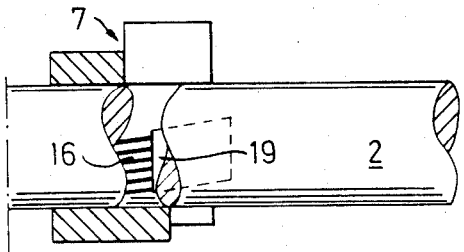
FIG. 8B
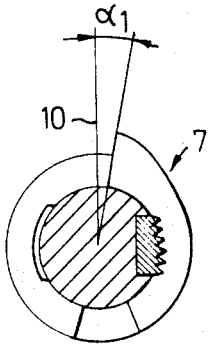
FIG. 9A
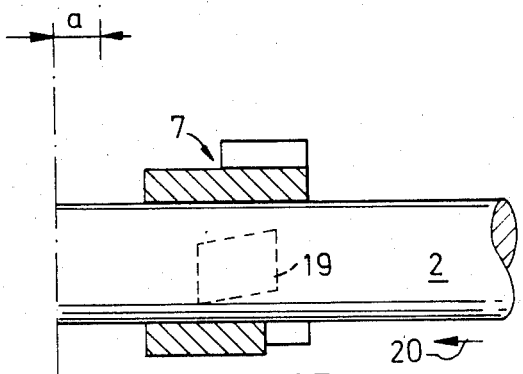
FIG. 9B
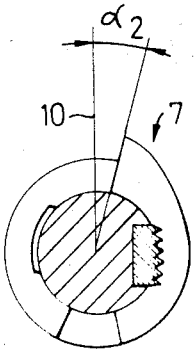
FIG. 10A
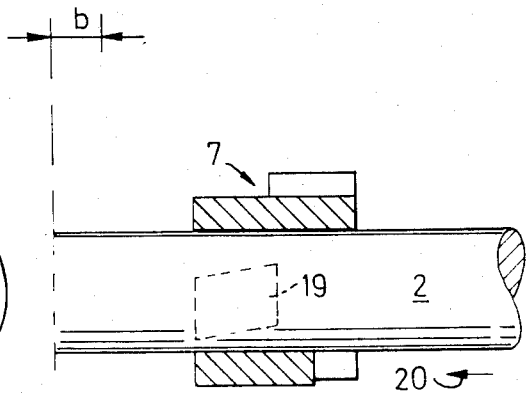
FIG. 10B

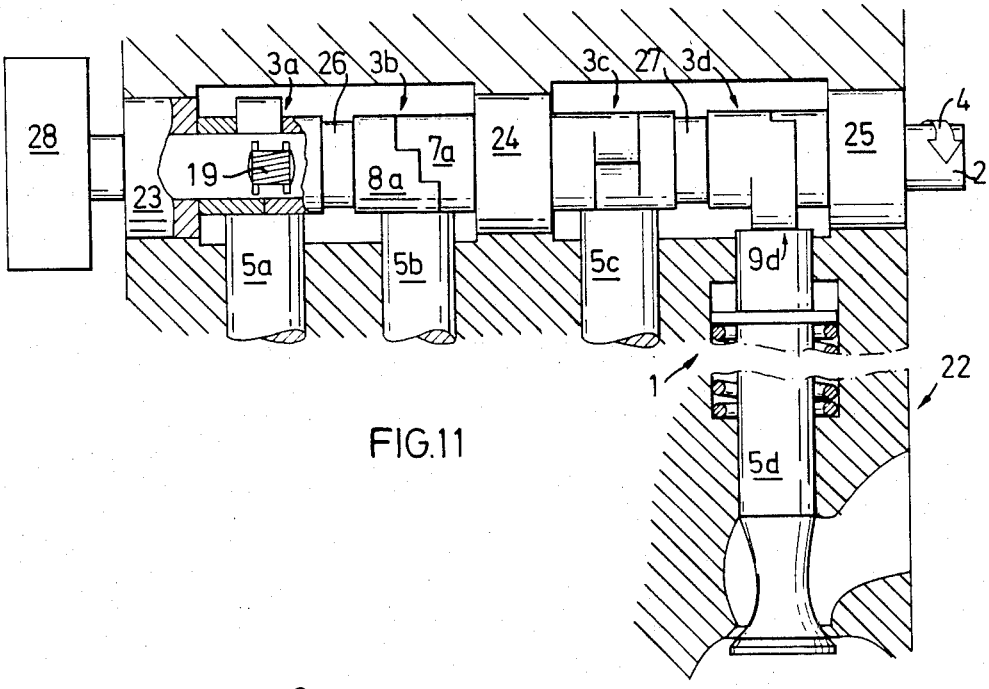
FIG.11
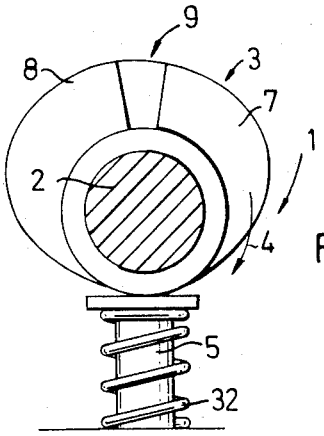
FIG.12
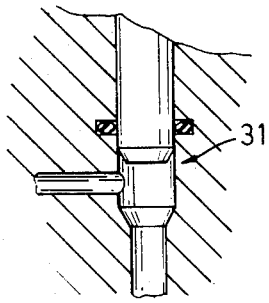
FIG.13
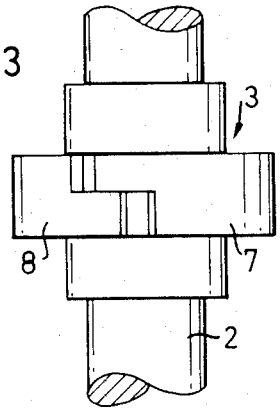

CAM APPARATUS WITH A ROTATABLE, VARIABLE-PROFILE CAM MEANS

The invention relates to a cam apparatus where a cam means, which is rotatable by means of a drive shaft, is intended to coact via its flank with a moving contact means or follower for controlling the follower motion as a function of the cam means rotation, said cam means comprising two cam members, at least one of which being settable relative to the other in the peripheral direction of the drive shaft, for resetting the shape of the cam means.

Cam apparatuses are to be found in a multitude of different connections within the technique of motion control. Such apparatuses are particularly used in internal combustion engine technology for controlling valve motion. In such cases it is usual for the cam means to be formed integral with its drive shaft to form a cam shaft which directly or indirectly actuates the valves so that their motion patterns are synchronized with the cam shaft rotation. This results in that the valves will be opened or closed at the same crank shaft position, independent of engine speed (rpm).

In an internal combustion engine intended for operation in vehicles, it is desirable that the engine functions well within a wide rpm range. The valve timing is therefore usually selected so that the best flow conditions in the engine will be achieved close to the middle of the rpm interval in which the engine is normally intended to work. This normal operational rpm interval can be selected arbitrarily within the total engine rpm range. A given engine can thereby be adapted to operate optimally, e.g. at low rpm, or medium rpm or at high rpm, mainly by selecting suitable valve timing during design.

Every internal combustion engine, e.g. of the four-stroke type, thus has a definite rpm at which the engine can function optimally (as during operation at full working load). When the engine operates at rpm which are lower or higher than the optimum rpm, the flow conditions in the engine will gradually deteriorate the further away from the optimum rpm the engine works. This signifies that the work per revolution by the engine decreases when the flow conditions deteriorate in the engine, due to the valve timing no longer suiting the rpm at which the engine is operating. It is obvious that improved engine efficiency would be achieved if it were possible to allow the engine to operate with different valve timing for different rpm. Also in connections other than those with internal combustion engines, enabling the variation of the motion pattern during operation would be very often desirable in such cases where a cam apparatus described in the introduction is utilized, e.g. in workshop machine technology.

Against this background it has been suggested, e.g. for aircraft radial engines, to use a variable cam apparatus where two cam members are mutually hydraulically displaceable by means of hydraulic passages provided in the cam members. Such a solution, however, is not feasible for an in-line type engine.

The object of the invention is to provide an improved cam apparatus enabling variation of the motion pattern in a simple and reliable manner for a follower controlled by a rotatable cam member.

A further object of the invention is to provide a cam apparatus which in a simple manner can be utilized to improve the efficiency in internal combustion engines, especially of the in-line type.

A cam apparatus in accordance with the invention is implemented such that each cam member surrounds the drive shaft like a sleeve and is in non-rotatable engagement therewith via a guide means which is so formed that mutual axial displacement between the drive shaft and the cam member provides relative displacement in the peripheral direction between drive shaft and cam member. It is to advantage if the cam members are adapted to move in opposite peripheral directions of the drive shaft for resetting.

With a simple and reliable cam apparatus in accordance with the invention it will thus be possible to vary the cam means profile during operation, resulting in that the follower is actuated in different ways, depending on what profile the cam means has at a particular instant. It will thus be possible to vary the opening and closing times for valves in an internal combustion engine, and this variation can be made dependent on the engine rpm and loading degree in different ways.

The invention will now be explained in detail in the following with the aid of an embodiment illustrated in the appended drawings, where FIGS. 1 and 2 illustrate a cam apparatus in accordance with the invention in two different setting positions, FIG. 3 is a side view of a cam means on a drive shaft, FIG. 4 is a view from above of the cam means in FIG. 3, FIG. 5 is an end view of a cam member incorporated in a cam means, FIG. 6 is a section along the line VI—VI in FIG. 5, FIG. 7 is a view from below of the cam member in FIG. 5, FIGS. 8A–10B schematically illustrate how a cam member is caused to vary its position on its drive shaft, FIG. 11 schematically illustrates how a cam apparatus in accordance with the invention can be utilized for controlling valves in an internal combustion engine, FIG. 12 illustrates a variant of the inventive cam apparatus, and FIG. 13 illustrates the cam means of FIG. 12, seen from above.

According to FIG. 1, a cam apparatus 1 comprises a rotatable drive shaft 2 on which a cam means 3 is non-rotatably mounted and, together with the drive shaft 2, rotates clockwise in the direction of the arrow 4. The cam means 3 coacts conventionally with a follower 5 to control the reciprocal motion of the latter in the direction of the double arrow 6. The cam means 3 is subdivided into two cam members 7 and 8, together forming a cam lobe top 9 which is parted along a parting plane 10 fixed relative the drive shaft 2 and passing through the centre thereof.

In FIG. 2 the two cam members 7 and 8 have been turned angles $\alpha°$ and $\beta°$ in opposite directions from the initial position shown in FIG. 1. The cam member 3 will thus actuate the follower 5 for a larger portion of its revolution than previously. Actuation will now start at an angle of $\alpha°$ earlier than before and terminate at an angle of $\beta°$ later than before.

From FIGS. 3 and 4 it will be more closely seen how the flank 11 of the cam means 3 is parted so that at least a first portion 12 of the flank is disposed on the member 7, while a second portion 13 of the flank is disposed on the member 8. In FIGS. 3 and 4 the cam members 7 and 8 assume a position corresponding to that in FIG. 1.

The more specific implementation of a cam member will be seen from FIGS. 5–7, where the cam member 7 is shown in more detail. The second cam member 8 has a corresponding shape and therefore does not need to be shown in detail. The cam member 7 has a sleeve-shaped portion 14 with a hole 15 intended for the drive shaft 2, there being one or more oblique guide grooves 16 in the wall of said hole, and the function of these grooves will be explained later on. In the wall of the hole 15 there is also a recess 17 extending in the longitudinal direction of the sleeve-like portion 14, the function of which will also be apparent later on.

The mutual coaction between the drive shaft 2 and a cam member 7 will be seen from FIGS. 8–10, where FIGS. 8A, 9A and 10A illustrate an end view, partially in section, and where FIGS. 8B, 9B and 10B illustrate a section along the line B—B in FIG. 8A. As will be seen from FIG. 8, the cam member 7 is non-rotatably engaged with the drive shaft 2 via a guide body 19 arranged in a recess 18 therein, the guide body 19 coacting with the guide groove or grooves 16 in the cam member 7. The recess 17 has the task of providing space for a guide body 19 (not shown) coacting with the second cam member 8 which has a corresponding second recess defined in it for providing space for a second guide body. The relative positions of the drive shaft 2 and the cam member 7, shown in FIG. 8, correspond to the position shown in FIG. 1, where the two cam members 7 and 8 are juxtaposed.

By fixing the cam member 7 axially and displacing the drive shaft 2 relative to said member, relative rotation between cam member and drive shaft may be obtained as will be seen from FIGS. 9 and 10. In FIG. 9, the drive shaft 2 has been displaced a distance a in the direction of the arrow 20 in relation to the cam member 7, whereby the latter has been turned an angle $\alpha_1$ relative the previously mentioned parting plane 10. In FIG. 10 the drive shaft 2 has been further displaced a distance b from the position shown in FIG. 9, whereby the cam member 7 has now been turned the angle $\alpha_2$ from the initial position shown in FIG. 8. It is obvious that the relative rotation between the drive shaft 2 and the cam member 7 is dependent on the gradient or pitch of the guide grooves 16. The greater the gradient is, the greater is the axial displacement required for the drive shaft 2 to achieve a given relative angular movement. The gradient of the guide grooves 16 can naturally be varied according to need, and neither does it need to be constant along the whole of the displacement length. It is of course also possible to change the direction of slope of the guide grooves 16 so that the illustrated relative angular movement is achieved by displacing the drive shaft 2 in the opposite direction instead.

It is obvious that the guide means 21, regulating the relative movement between the drive shaft 2 and the cam member 7 and in which the guide body 19 is incorporated, may be implemented in a variety of ways to suit different desires. By selecting several guide grooves 16 instead of a single guide groove, each of the guide grooves can be made shallower with retained torque transmission capacity. It is naturally imperative to see that the guide grooves 16 are not given such a gradient that self-locking occurs, i.e. that axial displacement of the drive shaft 12 relative the cam member 7 becomes impossible when the cam member 7 is axially fixed. Instead of displacing the cam shaft 2, it is naturally also possible to displace the cam member 7 axially with the aid of a suitable device, but this is on condition that the cam member has a relatively large axial extension so that it can retain suitable contact with its follower 5. The total mass of the cam means 3 will hereby increase in comparison with the previously described solution, and this is something which is often not to advantage. By displacing the drive shaft 2 in a direction counter to the arrow 20 from the position shown in FIG. 10, the initial position shown in FIG. 8 can once again be attained.

The two cam members 7 and 8 have up to now been shown as rotatable relative the drive shaft 2, in opposite directions, but other embodiments are also possible if required. One cam member can be non-rotatable for example, but even so allow an axial displacement between drive shaft and cam member. Another possibility is to make both cam members movable, but allow them to move in the same direction relative the drive shaft for resetting. An embodiment in accordance with the invention thus opens up rich possibilities for altering the motion pattern of the follower 5 in a desired manner during operation. The follower 5 may be such as a reciprocating rod, or one end of a rocker arm or the like.

A practically possible application of the embodiment described so far is shown in FIG. 11, where an internal combustion engine 22 is provided with a plurality of cam apparatuses 1 in accordance with the invention. The follower 5 for each of these cam apparatuses constitutes one end of the spring-loaded valve, which is urged by the respective cam lobe 9 to the open position. With the object of simplification, only the cam apparatus 1 shown furthest to the right in the figure has been depicted more completely. As will be seen, the drive shaft 2 rests in three spaced bearings 23, 24 and 25, each of which is locked axially. Between the bearings 23 and 24 the drive shaft 2 carries the cam means 3*a* and 3*b*, between which there is a spacer 26. In a corresponding manner, there are two cam means 3*c* and 3*d* between the bearings 24 and 25 with a spacer 27 situated between the cam means 3*c* and 3*d*. All the cam means 3*a*–3*d* are thus locked axially and are resettable in a manner previously described, with the aid of the drive shaft 2, which is reciprocally displaceable axially with the aid of a setting means 28 which may be formed so as to alter the position of the drive shaft 2 as a function of the engine rpm. As will be seen, the different cam means are mounted in different directions relative the drive shaft 2. The cam means 3*c* has to rotate a further angle of 90° before it will assume a position corresponding to that of the cam means 3*d*. In turn, the cam means 3*b* is at an angle of 180° after the cam means c, and must thus rotate an angle of 270° to come into the same position as the cam means 3*d* assumes. In its turn, the cam means 3*a* needs to turn an angle of 180° to come into the same position as the cam means 3*d*.

To achieve good coaction between cam means 3 and follower 5, the follower 5 has a concave surface 29 (see FIG. 1) facing towards the cam means 3 and having a radius of curvature 30 with its centre at the centreline of the drive shaft 2. When the cam members 7 and 8 are completely or partially moved apart (according to FIG. 2), the follower 5 will not hereby change position when, for example, one cam member 7 just leaves the surface 29. There is furthermore achieved that the two cam members 7 and 8 will be in contact with the surface 29 in the position where the contact pressure is greatest, i.e. when the follower is depressed to a maximum.

An alternative embodiment of the cam apparatus in accordance with the invention is shown in FIG. 12, where the follower 5 is incorporated in a valve 31 which is shown on the drawing in an open position when the follower 5, with the aid of a spring 32, is kept in its uppermost position. Contrary to the embodiment shown in FIG. 1, the valve 31 is thus kept closed against the bias of the spring 32 with the aid of a cam means 3 during a large part of the revolution of the drive shaft 2. In this case, the lobe top 9 will thus be substantially greater than in the previous case. To increase the opening time of the valve, i.e. reduce the time the valve is closed, the cam members 7 and 8 must thus be moved together, which can be done in a corresponding manner as previously described, although the guide grooves 16 must be given another gradient to obtain the desired motion pattern. By forming the two cam members 7 and 8 in the manner apparent from FIG. 13, it is possible to provide a continuous transition between the two cam members at the lobe top, independent of the relative positions of the can members 7 and 8.

Apart from the embodiments described above, further embodiments are conceivable within the scope of the invention. For example, it is possible to form each cam means with an axially fixed portion and one or more movable portions. In such a case the axially fixed portion can possibly be formed integrally with the drive shaft. It is also possible to have more than two cam members which are all movable relative the drive shaft. The cam flank can also be parted at other places than at the top of the lobe, depending on what motion pattern is desired. The gradient of the guide grooves can possibly vary between positive and negative, i.e. after a certain relative axial displacement between cam member and drive shaft the cam member will change its direction of rotation relative the drive shaft. In an engine, the resetting of the cam apparatus can be made dependent on a plurality of different parameters such as rpm and degree of load, for example, depending on how it is desired to affect operation

I claim:

1. A cam apparatus comprising:

a drive shaft;

a cam means on the drive shaft and having a cam flank for coacting with a movable follower for controlling the motion of the follower; the cam means comprising first and second cam members, each cam member having a sleeve-shaped portion with a hole for fitting around and receiving the drive shaft and being displaceable in a respective peripheral direction in relation to the drive shaft for varying the shape of the cam flank, the respective peripheral directions being opposite each other; the cam members being immovable axially in relation to each other during displacement thereof in the respective peripheral directions; and a guide means for engaging the drive shaft and the sleeve-shaped portion of each cam member for displacing each cam member in the respective peripheral direction for varying the cam flank shape when the drive shaft is displaced axially in relation to the cam members.

2. A cam apparatus as claimed in claim 1, wherein the guide means prevents the drive shaft from rotating in relation to the cam members when the drive shaft is axially stationary with respect to the cam members.

3. A cam apparatus as claimed in claim 1, wherein the sleeve-shaped portion of each of the first and second cam members has an inner wall facing the drive shaft and wherein a guide means comprises first and second guides for the first and second cam members, respectively, each guide having at least one guide groove defined in the inner wall of the sleeve-shaped portion of the first and second cam members, respectively; the guide means further comprising first and second guide bodies on the drive shaft, the first and second guide bodies being adapted for engaging the first and second guides, respectively.

4. A cam apparatus as claimed in claim 3, wherein each guide groove is oblique with respect to the drive shaft.

5. A cam apparatus as claimed in claim 4, wherein the drive shaft has first and second recesses defined therein, the first and second guide bodies being disposed in the first and second recesses, respectively.

6. A cam apparatus as claimed in claim 1 comprising a plurality of the cam means, which includes the first-mentioned cam means, on the drive shaft; the cam apparatus further comprising a spacer mounted between each adjacent pair of the plurality of cam means.

7. A cam apparatus as claimed in claim 6, wherein at least one spacer is a bearing for supporting the drive shaft.

8. A cam apparatus as claimed in claim 1, wherein the cam flank of the cam means defines a cam lobe top where the cam flank is at a maximum radial distance from the center of the drive shaft, each of the cam members having a respective lobe portion for defining a part of the cam lobe top, the cam members being peripherally displaceable between a first position in which the respective lobe portions of the cam members meet near the cam lobe top and a second position in which the cam members are spaced apart at the cam lobe top.

9. A cam apparatus as claimed in claim 8 further comprising a frame for supporting the drive shaft and a movable follower having a concave surface and being movably mounted on the frame with the concave surface facing the cam flank for permitting the cam flank to sweep across the concave surface; the concave surface having a radius of curvature at least as great as the maximum radial distance from the center of the drive shaft to the cam flank; the concave surface extending in the direction of the sweeping of the cam flank for contacting at least one of the first and second cam members at all times when the cam lobe top of the cam flank is sweeping across the concave surface.

10. A cam apparatus as claimed in claim 1 wherein the cam flank of the cam means defines a cam lobe top; each of the first and second cam members having a respective lobe portion for defining a part of the cam lobe top, the cam members being peripherally displaceable between a first position in which the respective lobe portions of the cam members meet near the cam lobe top and a second position in which the respective lobe portions of the cam members are spaced apart in the peripheral direction near the cam lobe top, the cam lobe top having a substantially constant radius of curvature in the area where the respective lobe portions of the cam members meet; the cam members overlapping each other in the peripheral direction in this area for obtaining a substantially continuous cam flank at the cam lobe top independent of the relative positions of the cam members.

11. A cam apparatus comprising:

a drive shaft;

a cam means on the drive shaft, the cam means comprising first and second cam members, each cam member having a sleeve-shaped inner wall facing the drive shaft and a respective cam profile surface disposed outward from the inner wall, the respective cam profile surfaces of the first and second cam members together defining a cam profile for controlling the motion of a movable follower as the cam means rotates, the respective cam profile surface of each cam member being displaceable in a respective peripheral direction relative to the drive shaft; and a guide means for displacing each cam member in the respective peripheral direction for varying the cam profile shape when the drive shaft is displaced axially relative to the cam members.

12. The cam apparatus of claim 11 in which the first and second cam members each have a first side disposed toward each other, and a second side opposite the first side, the cam members abutting each other on the first sides in an axial direction relative to the drive shaft, the cam apparatus further comprising first and second spacers disposed along the drive shaft adjacent the second sides of the first and second cam members, respectively, for preventing the cam members from moving relative to each other in the axial direction.

13. The cam apparatus of claim 11 in which the guide means further prevents the drive shaft from rotating in relation to the cam members when the drive shaft is axially stationary with respect to the cam members.

14. The cam apparatus of claim 6 in which the guide means comprises first and second guides on the inner walls of the first and second cam members, respectively, the guide means further comprising first and second guide bodies on the drive shaft for engaging the first and second guides, respectively.

15. The cam apparatus of claim 14 in which each guide has at least one guide groove, each guide groove being oblique with respect to the drive shaft.

16. The cam apparatus of claim 14 in which the drive shaft has first and second recesses defined therein, the first and second guide bodies being disposed in the first and second recesses, respectively.

17. The cam apparatus of claim 11 in which the cam profile has a lobe top, the respective cam profile surfaces of the first and second cam members each being displaceable between a first position in which the lobe top is relatively narrow and a second position in which the lobe top is relatively wide.

18. The cam apparatus of claim 17 in which the first and second cam members have first and second lobe portions, respectively, the first and second lobe portions being nearer each other near the lobe top in the first position and being spaced apart in the peripheral direction in the second position.

19. The cam apparatus of claim 12 in which the first and second lobe portions overlap each other in the peripheral direction in the first position for providing a continuous cam profile when the first and second lobe portions are in the second position.

* * * * *